US007425900B2

(12) United States Patent
Lynn et al.

(10) Patent No.: US 7,425,900 B2
(45) Date of Patent: Sep. 16, 2008

(54) CLEAN HANDS ASSURED WITH SIGNAL

(75) Inventors: John Morris Lynn, Austin, TX (US); Kathryn Anne Newth, Round Rock, TX (US)

(73) Assignee: Airborne Health, Inc., Bonita Springs, FL (US)

( * ) Notice: Subject to any disclaimer, the term of this patent is extended or adjusted under 35 U.S.C. 154(b) by 121 days.

(21) Appl. No.: 11/098,272

(22) Filed: Apr. 4, 2005

(65) Prior Publication Data

US 2005/0231373 A1 Oct. 20, 2005

Related U.S. Application Data

(60) Provisional application No. 60/560,631, filed on Apr. 8, 2004.

(51) Int. Cl.

| | |
|---|---|
| ***G08B 13/14*** | (2006.01) |
| ***A47L 1/06*** | (2006.01) |
| ***B67D 5/06*** | (2006.01) |
| ***B65D 35/00*** | (2006.01) |
| ***B44D 3/00*** | (2006.01) |
| ***B43L 21/00*** | (2006.01) |

(52) U.S. Cl. ..... 340/573.1; 15/244.4; 15/245; 15/1; 222/92; 222/175

(58) Field of Classification Search ..... None
See application file for complete search history.

(56) References Cited

U.S. PATENT DOCUMENTS

| | | | | |
|---|---|---|---|---|
| 5,900,067 | A | 5/1999 | Jones | |
| 6,029,600 | A | 2/2000 | Davis | |
| 6,065,639 | A * | 5/2000 | Maddox et al. | 222/36 |
| 6,147,607 | A * | 11/2000 | Lynn | 340/573.1 |
| 6,211,788 | B1 * | 4/2001 | Lynn et al. | 340/573.1 |
| 6,524,390 | B1 | 2/2003 | Jones | |
| 6,814,816 | B2 | 11/2004 | Achar et al. | |
| 7,053,029 | B2 | 5/2006 | MacDonald et al. | |
| 2001/0053981 | A1 * | 12/2001 | Wyssen | 705/1 |
| 2002/0030742 | A1 * | 3/2002 | Aman et al. | 348/169 |
| 2002/0030792 | A1 | 3/2002 | Aman | |

* cited by examiner

*Primary Examiner*—Julie Lieu
(74) *Attorney, Agent, or Firm*—Novak Druce + Quigg LLP

(57) ABSTRACT

A method and apparatus are disclosed for helping assure the washing of a person's hands. An easily identifiable substance is provided which may be removed by washing. A marking mechanism is coupled with or contains the easily identifiable substance and the hand of the person is then marked with the easily identifiable substance when the marking mechanism is triggered. Substantially concurrent (or somewhat delayed) with the hand being marked a signal is given off which helps assure that the person actually uses the marking mechanism. Another way to coerce use of the marking mechanism and to allow authority figures to monitor use of the marking mechanism is a information recording device which tracks use of the marking mechanism.

20 Claims, 2 Drawing Sheets

CLEAN HANDS ASSURED WITH SIGNAL

CROSS REFERENCE TO RELATED APPLICATIONS

This patent application is claiming priority under 35 USC 119(e) to provisional patent application entitled "Clean Hands Assured with Signal" having a provisional application Ser. No. 60/560,631 and filing date of Apr. 8, 2004.

TECHNICAL FIELD OF THE INVENTION

The present invention relates in general to the field of maintaining sanitation to a method and apparatus for helping to assure the washing of hands.

BACKGROUND OF THE INVENTION

In a variety of different fields, businesses and residences, there is a great desire that people wash their hands more effectively and more frequently. The US Center for Disease Control has stated that "The most important thing you can do to keep from getting sick is to wash your hands". And yet, many people, through lack of knowledge, poor habits or simple negligence either do not wash their hands frequently enough or effectively enough.

An example of a specific need for assuring sanitized hands is the food services industry. It has been known for many decades that food preparers, servers and so forth should clean and sanitize their hands prior to handling food to be served. This need is self-evident when food service employees enter restrooms. Bacteria (such as *E-coli*, those found in fecal matter, uncooked foods etc) in restrooms are well known health hazards and without proper cleaning/sanitization of the hands of restaurant employees, can be transmitted to unknowing customers. These and other concerns also suggest a need for sanitizing hands in private residences, especially in homes with children.

Currently, food service concerns, parents as well as health industry participants are trying to address the problem with rules and regulations concerning hand washing. For instance, in many food service establishments there are signs which state roughly "Employees must wash their hands before leaving." Methods which require adherence to a rule or policy by human beings with little or no reinforcement or monitoring are typically insufficient to maximize compliance. Importantly, such rules and regulations do little or nothing to assure that even if hand washing is done, it is done correctly (i.e. with enough disinfecting medium, for a long enough period of time to kill the germs, or with sufficient scrubbing).

Presently there are both patented and unpatented systems intended to address the problem of insufficient hand washing. These systems are typically very complex and, accordingly, prohibitively expensive. U.S. Pat. No. 5,670,945, for example, discloses a complex system that has a sanitizing basin with moisture proof switches inside the sanitizing basin and proximity detectors. A person must insert both hands simultaneously into the sanitizing basin in order to initiate the desired output signal. U.S. Pat. Nos. 6,426,701; 5,945,910; 5,812,059; 5,202,666; 4,896,144; 3,967,478; 5,610,589; 4,688,585 and 5,199,188 and U.S. patent applications Ser. Nos. 20030030562; 20030197122; 20030019536; and 20040001009 all involve relatively complex systems containing such things as complex electronics, location sensors; pumps and so forth (often mixed together in complex attempts to require handwashing). In summary, the presently available systems are typically expensive, complex to install, difficult to maintain and it can be difficult to train users in their operation.

One such concept is disclosed in U.S. Pat. Nos. 6,031,461; 6,147,607 and 6,211,788. These patents disclose a method and apparatus to assure the washing of hands by marking a person's hand with an easily identifiable substance which requires the washing of the hands when a person does something where washing of the hands would be desirable. These prior art patents cover broadly the concept of marking of the hands in order to achieve washing of the hands.

SUMMARY OF THE INVENTION

There is a need for a simple, inexpensive method to help assure that people wash their hands frequently and effectively. Especially desirable is a system that is simple and inexpensive enough to allow it to be put into almost any setting without costly retrofitting of bathrooms or hand washing areas.

In accordance with the present invention, a method and apparatus are disclosed for helping to assure the washing of hands that provide advantages over prior sanitization assurance schemes.

According to one aspect of the present invention, a method for helping to assure washing of hands preferably involves applying an easily identifiable substance to the hand of a person and concurrently (or with some delay) signaling that the marking of the hand has occurred. The substance can be removed from the hand by washing with a cleansing medium for a period of time sufficient to help assure sanitary hands and concurrently (or roughly concurrently) signaling that the marking of the hand has occurred. In an exemplary embodiment, a marking mechanism is coupled to the easily identifiable substance, and a hand of a person is marked with the easily identifiable substance when the marking mechanism is triggered (it may also be possible to include a cleansing medium with the easily identifiable substance). The person then is required to wash their hands or bear the mark which makes it obvious that their hands have not been washed since receiving the mark.

In accordance with the teachings of the present invention, effective hand washing is not contingent upon incorporation of a marking mechanism into an existing actuating mechanism (e.g. door knob, gate handle or toilet flushing mechanism). As a result, the hand washing assurance mechanism incorporating the teachings of the present invention provides cost savings advantages over many existing technologies and avoids more expensive mechanisms and/or retrofitting.

The present invention also provides the technical advantage of targeted application. As existing technologies are in essence involuntary systems they typically mark all persons who come into contact with the marking mechanism (door knob, etc.) each and every time they use the system, without discriminating between types of users. In many instances this is not desirable since certain circumstances may warrant the marking of employees but not customers (e.g., in a restaurant scenario) or children but not adults (e.g., in a residence where one wants to encourage their children to wash their hands but not adults or visitors to the home).

In an exemplary embodiment of the present invention, the marking mechanism may be a standalone device unrelated to other mechanisms such as door knobs, toilet flushers, and so forth (although the present invention can be used coupled with or integral with mechanisms such as those mentioned above and others such as liquid soap dispensers). Since it is typically implemented as a standalone device, it is desirable to have a means of coercing persons to utilize the marking mechanism essentially voluntarily. In accordance with the teachings of the present invention, a means to remind and/or urge persons to use the marking mechanism may be implemented through the use of a signal means actuated substantially concurrently with the utilization of the marking mechanism by a person. The signal means can produce audible, visual, olfactory, tactile, kinetic or other signal forms. The signal means are designed to make failure to use the marking mechanism obvious.

The concept is generally that when the marking mechanism is used routinely (e.g. by restaurant employees as they enter a hallway leading to the restrooms) people become accustomed to hearing or seeing the signal means. As users develop their routine, failure to use the marking mechanism and activate the signal means becomes obvious to both the intended user (e.g. the restaurant employee who does not hear the signal as he enters the hallway leading to the restrooms) and others who expect to hear or see the signal (e.g. restaurant management or customers). The signal or lack thereof, may begin to have a Pavlovian response. Accordingly, transforming an essentially voluntary action into almost a reflexive action. As a result, use of the marking mechanism and accompanying signal preferably serve as a sign of cleanliness and hygiene and will comfort others interested in hand washing (e.g. restaurant customers and parents of children).

The signal means preferably acts as both a reminder and as a positive reinforcement. It is possible that children in households would be praised each time they "rang the bell" (or played a favorite song which could be used as the audible signal) when marking their hands. There could be a series of different songs or noises that could be chosen from a menu. The marking mechanism may be placed proximate to a bathroom sink. It is possible that the marking mechanism becomes of game for a child that teaches them how to wash their hands correctly for the necessary amount of time and with the proper amount of cleansing medium (i.e. the easily identifiable substance will not come off with insufficient hand washing). In addition to designing the easily identifiable substance to wash off only after some minimum period of time, it is possible that the signal may also reinforce this time requirement by sounding for some minimum period of time (e.g. a child's song that lasts the 15-20 seconds necessary to assure killing of germs on the hands). In this way the child has two entirely different prompts that will help assure some minimum period of hand washing.

Another means of helping to coerce or urge use of the apparatus could be an information recording means which records and/or displays information relating to use. Examples of information that might be displayed are a frequency of use of the marking mechanism and/or particular times it was used. In this manner, for example, a parent could, at the end of a day, check how often a child had used the device and the timing of its use. It could be used to see trends in hand washing and reward positive behavior and attempt to change insufficient hand washing. This information would allow a parent (or employer) to monitor hand washing protocol. Even better, because the mark is designed to require a specific type of hand washing (e.g. hot water and soap for a minimum of 15 seconds) the invention essentially not only monitors frequency of hand washing but also an effectiveness of hand washing.

The present invention may be used in any situation where it is desirable that a person washes their hands. Medical studies show that washing hands numerous times a day dramatically decreases illnesses. Accordingly the invention may be used in various entrances or areas of a home or business.

In one aspect, the present invention provides the technical advantage of assuring individuals wash their hands by marking their hands with an easily identifiable substance. The easily identifiable substance is preferably designed to require the specific type and duration of hand washing desired for the end use (e.g. soap and water in a home and an alcohol cleanser in a hospital). It is another technical advantage of the present invention that it is an extremely simple and inexpensive system and method which can be easily placed in any entrance, exit or other area of a home or business without changing existing fixtures or retrofitting. It is another technical advantage of the present invention that use of the marking mechanism is coerced through either use of the signal means or use of the recording means.

Other technical advantages of the present invention should be apparent from the drawings and specification.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1:
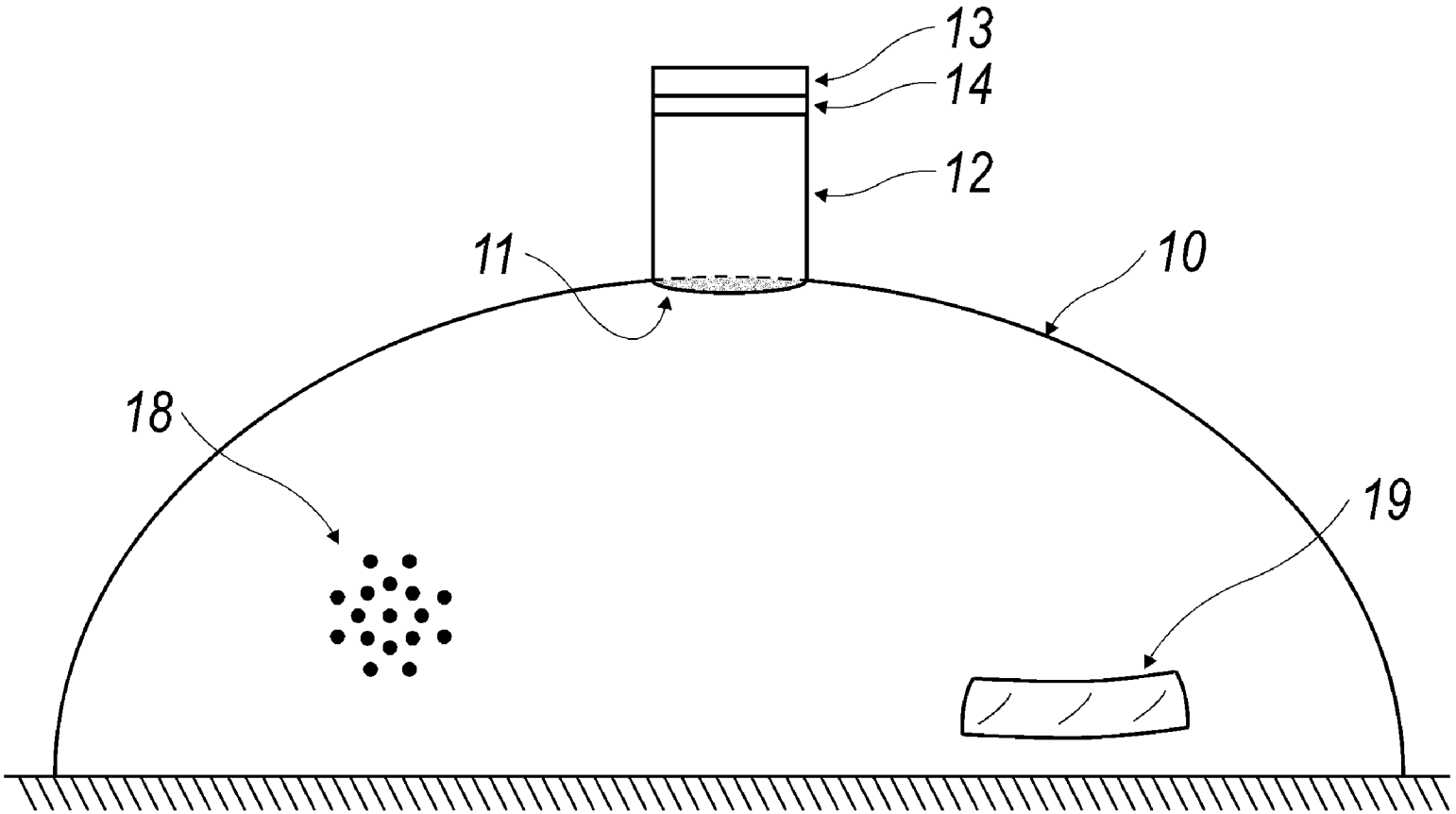
FIG. 1 is a side view of the exterior of one embodiment of a marking mechanism with an audible signal device according to teachings of the present invention.

FIG. 1 is an horizontal exterior view of one embodiment of a marking mechanism with an audible signalling device. In the embodiment of FIG. 1, the marking mechanism preferably comprises a cover 10 with an opening 11 for cylinder 12 and speaker openings 18 and electronic display window 19. Cover 10 is preferably designed to sit substantially flat on a surface such as a table, sink or counter. Cover 10 may also be configured to mount on a wall or other vertical surface. The shape of cover 10 may be varied. For example for use with children, it may be desirable to make cover 10 in the shape of an animal or action hero. In a further example, it may be desirable to match the audible signal of the device with the shape of the cover (e.g. having a frog shaped cover making a croaking noise as the signal).

Preferably inserted through opening 11 is cylinder 12. Cylinder 12 is preferably movable up and down through opening 11. Absorbent pad 13 is preferably detachably attached to cylinder 12 using attachment means 14. Absorbent pad 13 preferably contains an easily identifiable substance to mark the hands of a person when they push down on absorbent pad 13 and cylinder 12. When absorbent pad 13 either runs out of the easily identifiable substance or when the easily identifiable substance drys out and no longer marks a person pushing down on absorbent pad 13 it is preferably possible to remove absorbent pad 13 by removing attachment means 14 and then placing a new absorbent pad 13 and/or attachment means 14 on the top of cylinder 12. FIG. 1, also shows display window 19 which is preferably operable to display information concerning the use of the marking mechanism, e.g. frequency of use, timing of use, user identification, as well as other characterisitics.

Figure 2:
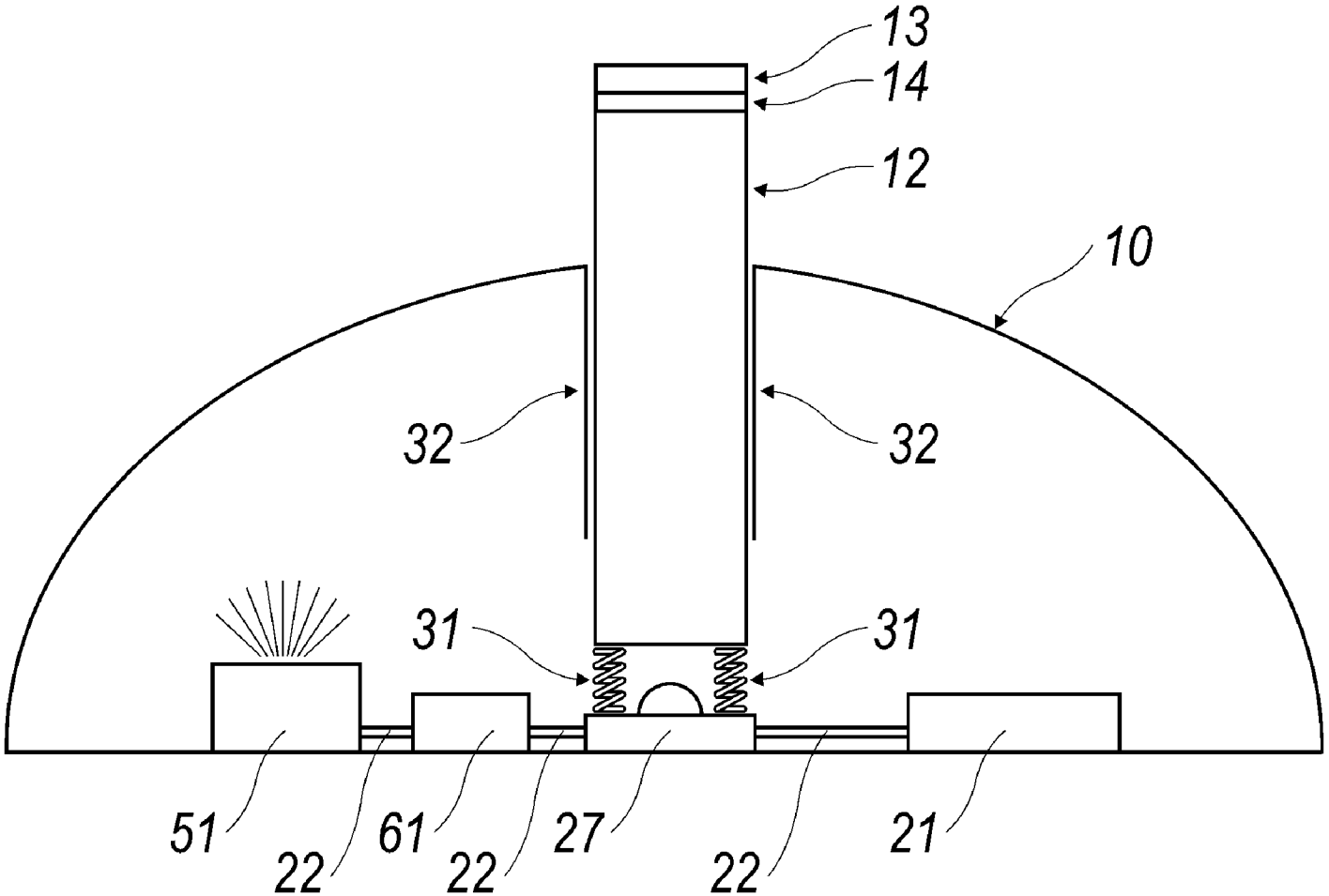
FIG. 2 is a cross-sectional view of the device of FIG. 1 showing an internal structure of a marking mechanism and signal means according to teachings of the present invention.

FIG. 2 is a cross-sectional view of the device of FIG. 1 showing an exemplary configuration of the present invention. FIG. 2 shows that cylinder 12 is preferably movable within the interior of cover 10 and may be guided within a specific channel by interior walls 32. Preferably included in cover 10 is signaling means 51, power supply 21, and recording means 61. Also preferably included is switch 27 which preferably allows power to flow from power supply 21 to signal means 51 and electronic recording means 61. Accordingly, switch 27 is preferably operable to selectively couple signaling means 51 and recording means 61 to power supply 21 via one or more wires 22 or other electrical conduits. Switch 27 may be implemented using a variety of technologies including but not limited to contact switches, micro-electro-mechanical switches, pushbutton, toggle, slide, as well as other switches.

Recording means 61 is preferably maintained in communication with display window 19. Display window 19 preferably displays on the exterior of cover 10 information recorded by recording means 61. This information, for example, may be things such as how many times the apparatus was activated during a particular period of time and the times of the activation, as well as other characteristics. Signal means 51 and recording means 61 are preferably activated when switch 27 is activated. Further, switch 27 is preferably activated when cylinder 12 is pushed downward. The normal unbiased position of cylinder 12 is an upward position which may be facilitated using springs 31 to push cylinder 12 upward.

In an upward biased position, cylinder 12 is preferably not maintained in contact with switch 27. And accordingly signal means 51 and recording means 61 are preferably not activated and no sound or signal is produced by signal means 51 nor is any activity recorded by recording means 61 in such circumstances. The use of switches, power supplies and signal means capable of generating sounds are known in the art and as such various modifications may be made to the exemplary embodiment discussed here in without departing from the spirit of the teachings of the present disclosure.

In an alternate embodiment of the invention (not expressly shown) the signal means may be located remote from the marking mechanism. This configuration may be desirable where a person monitoring hand washing (e.g. restaurant manager or parent of a young child) desires to have the signal presented at a location other than where the marking mechanism is placed. For example, a parent may not be able to detect the signal from the apparatus if it goes off only in the child's bathroom area. In such case the parent may desire to have one or more remote signal means in another area of the house such as the kitchen or living room. This may be done by hardwiring the signal means to a remote location or using one or more wireless technologies. In general, remote communication my be facilitated by placing one or more transmitters/transceivers in communication with one or more receivers/transceivers. Examples of wireless technology capable of communicating in accordance with the teachings of the present invention include without limitation, IEEE 802.11 x technologies, Bluetooth, GSM (Global system for mobile communications) 3GSM, CDMA, TDMA, infrared, radio spectrum, as well as others.

Persons skilled in the art may realize that recording means 61 may be implemented using a variety of different technologies, including without limitation, one or more of the following: IC, ASIC, EEPROM, memory and processor combinations, mechanical counters, as well as others. could be done a number of different ways. With integrated circuits getting cheaper and cheaper as Moore's Law drives down semiconductor costs, it is possible that a great of variety of different types of information may be cheaply collected, stored and displayed. In fact in a business scenario with many users of the invention, it may be desirable to track the actions of specific employees and their use of the marking mechanism by having the employees wear electronic badges (e.g. RFID devices) or using biometrics which allow recording means 61 to differentiate the actions of different persons using the apparatus. The timing of the use of the present invention may also be compared with the timing of the use of soap dispensers or water faucets or other devices used in hygiene processes.

Those skilled in the art may recognize that the marking mechanism may also be implemented using a variety of technologies and configurations. For example the marking mechanism may include any of the marking mechanism types set forth in U.S. Pat. Nos. 6,031,461 or 6,211,788. The marking mechanisms could be comprised of systems such as: (1) mechanical, (2) pneumatic, (3) pneumatic (mechanical), (4) electronic, (5) any combination thereof and others.

In addition, the easily identifiable substance could delivered to the skin in a variety of ways in addition to contact with absorbent pad 13. Other options include spraying, stamp pads and so forth. The present invention can provide benefits to any such marking mechanism, and the specific type of marking mechanism is relatively unimportant.

In addition, the easily identifiable substance can also be a great variety of different types of substances such as set forth in the '461 and '788 patents. These include inks, dyes, paint, stain, pigment, grease and any combination thereof. The easily identifiable substance may also be designed such that it is not easily identifiable visually, but instead is easily identifiable using other detection means such UV light, or using small metallic substances which are electronically detectable. The easily identifiable substance could be comprise even more exotic substances such as extremely tiny integrated circuits (sometimes referred to as "smart dust").

In the embodiment of FIGS. 1 and 2, the marking mechanism preferably operates as a mechanical trigger which activates signal means 51 and also marks the hand of the person pushing down on the absorbent pad 13 with the easily identifiable substance. Once the easily identifiable substance is on a person's hand it is likely the person will wash his hand to remove the mark. Removing the mark from the one marked hand will typically require the use of the other unmarked hand. The result, is two clean hands.

In an exemplary embodiment the top of cylinder 12 is preferably covered with detachable attachment means 14. Detachable attachment means 14 is preferably covered with absorbing pad 13 saturated or containing an easily identifiable substance (not expressly shown on the drawings since in this particular embodiment it is an integral part of absorbent pad 13).

In this particular embodiment of the invention there may be no automatic means to replenish the supply of the easily identifiable substance. As such, it may be necessary that absorbing pad 13 be removable from cylinder 12 and also that a new absorbing pad 13 having an easily identifiable substance be attached to cylinder 12 to replace the spent one. This replacement of absorbent pad 13 may be accomplished with the use of detachable attachment means 14. In addition to absorbent pads it may be possible to use stamps or cartridges which also can be replaced as they go dry.

It is foreseen that in such an embodiment people may buy multiple sealed packages containing absorbing pads 13 saturated with an easily identifiable substance and connected to detachable attachment means 14 (which may be double sided tape (which are widely available commercially). A wide variety of absorbing materials and absorbent pads may be satisfactorily used with the present invention such as those found on commercially available stamp pads. An example of absorbent materials include without limitation, the absorbing materials set forth in U.S. Pat. No. 6,211,788.

In addition to using double sided tape as the detachable attachment means 14, there are a number of other means which may be satisfactorily used to detachably attach absorbing pad 13 to the top of cylinder 12 that will be readily apparent to those skilled in the art (e.g. a Velcro-type TM system, non-permanent adhesive glues and/or gels, etc). It may also be possible to deliver the easily identifiable substance in ways that do not require changes of a cartridge or pad (e.g. gravity feeding, pumping from a reservoir and so forth).

It is a highly desirable advantage of this invention that the easily identifiable substance can be chosen or designed such that the desired type of hand washing is necessitated, once applied. For example, the easily identifiable substance may be designed such that it can only be removed by washing it off with a cleansing medium (e.g. liquid soap) and hot or warm water for a sufficient period of time, thereby maximizing sanitation of a person's hands. A commercially available easily identifiable substance is a turquoise I-7054 ink 203-52 from Ranger Ink. Another is "Care Bears Lite Up Stampers" from Rose Art, Inc. In a cleansing experiment, the Ranger Ink and Care Bear easily identifiable substance came off very slowly (over a minute) with water only, but came off in a desirable 15-20 seconds with soap and warm water. Also when applied both inks were further observed to dry very quickly upon application to a hand and therefore smearing or staining other articles was unlikely. It may be desirable to put the ink on a nib or other absorbent substance and to surround the inked nib (leaving an opening to mark the hand) with a compressible foam to prevent inadvertent smearing on items other than a person's hand.

In a highly sanitary area such as a hospital, nursing home or doctors office, the easily identifiable substance may be designed such that the only effective cleansing medium is a highly effective anti-germ or anti-bacterial substance (e.g. alcohol based).

In order to prevent persons from attempting to bypass the marking mechanism by using a paper towel, toilet tissue or a cloth as a barrier between their hand and the marking mechanism, the marking mechanism can use, for example, techniques like those disclosed in U.S. Pat. No. 6,147,607. These include things such as finger guides which require the marking to be done by the web of the finger (making covering the marked area with paper or cloth problematic) or also a rough surface (e.g. Velcro-like) on the marking mechanism which will retain fibers or threads from the barrier used, thus making an attempt to bypass the marking mechanism obvious. This application would be especially useful in residences where a limited number of people use the marking mechanism and attempts to bypass it are easier to trace to a particular person.

In another embodiment of the invention, the marking mechanisms disclosed herein can be used redundantly with a back up electronic detection system to determine whether a person has entered a restroom. One such electronic system using name tags is disclosed in U.S. Pat. No. 5,610,589.

In an exemplary embodiment of the invention marking of the hand maybe done in such a manner that, during the interim period between marking the hand and washing the hand, the easily identifiable substance is formulated and placed on the hand in such a way that smearing or staining of clothes or other items is minimized. In an area where there is a wash basin, minimization of smearing or staining may be achieved by placing the marking mechanism in close proximity to the wash basin. In this case, a person activates the marking mechanism immediately before washing their hands at the adjacent wash basin, thus minimizing chances for smearing or staining of other items. An example environment may be in a child's bathroom, immediately beside the sink.

In cases where proximity to a sink is not possible, minimization of staining or smearing can be accomplished by placement of the easily identifiable substance on an area of the hand which is unlikely to come into contact with other items. For example the mark can be placed in between the fingers on the web of the hand, on the palm of the hand or on the back of the hand. Placement of the mark on a particular part of the hand can be accomplished by use of things such as finger guides and/or triggers which guide the hand to a desired position prior to marking. In addition, the marking mechanism may be designed such that the easily identifiable substance is applied to the hand in a very thin layer (e.g. as accomplished with stamping mechanisms), thereby maximizing speed of drying and minimizing smearing or staining.

Another manner in which to minimize smearing or staining (or to make smearing or staining less of a problem should it occur) is to formulate the easily identifiable substance such that it is comprised of a composition which is easily removable from clothes and other items. For an example of an easily identifiable substance that is washable see U.S. Pat. No. 5,043,013 issued to Kluger et al. entitled "Washable Ink Compositions". U.S. Pat. No. 6,147,607 also sets forth various substances which are more easily washable than typical inks, dyes or pigments. This minimization of smearing and staining as well as ultimate washability of the easily identifiable substance is especially important in an embodiment of the invention where the marking mechanism is at the entrance to a restroom or the hallway leading to a restroom, and where presumably, a person will be handling their cloths shortly after being marked.

This notion of "dirtying" one's hands in order to subsequently get them more effectively clean may be counter-intuitive, but it results in especially clean hands if the easily identifiable substance, marking mechanism and signal means are well chosen.

Although the present invention has been described with respect to a specific preferred embodiment thereof, various changes and modifications may be suggested to one skilled in the art and it is intended that the present invention encompass such changes and modifications.

We claim:

1. A hand cleansing verification system, comprising:

an actuable hand marking mechanism configured, upon actuation, to dispense a marking substance and to initiate generation of an actuation signal at a signal generator, and thereafter, transmission of the generated actuation signal to a signaling mechanism;

said dispensed marking substance being third-party identifiable until diminished by sufficiently prolonged exposure to disinfectant; and said signaling mechanism configured to produce a third-party perceivable signal signifying actuation of said marking mechanism upon receipt of a transmitted actuation signal from said signal generator, said signal generator and said signaling mechanism being in signal communication with one another.

2. The hand cleansing verification system as recited in claim 1, wherein said signal generator and said signaling mechanism are in wired signal communication with one another.

3. The hand cleansing verification system as recited in claim 2, wherein said signaling mechanism is remotely located relative said marking mechanism.

4. The hand cleansing verification system as recited in claim 3, wherein said signaling mechanism is in a different room from said marking mechanism.

5. The hand cleansing verification system as recited in claim 1, wherein said signal generator and said signaling mechanism are in wireless signal communication with one another.

6. The hand cleansing verification system as recited in claim 5, wherein said signaling mechanism is remotely located relative said marking mechanism.

7. The hand cleansing verification system as recited in claim 6, wherein said signaling mechanism is in a different room from said marking mechanism.

8. The hand cleansing verification system as recited in claim 5, wherein said wireless signal communication is BLUETOOTH based.

9. The hand cleansing verification system as recited in claim 1, wherein said marking substance is resistant to being diminished by water alone.

10. The hand cleansing verification system as recited in claim 9, wherein said marking substance is diminished by disinfectant soap.

11. The hand cleansing verification system as recited in claim 9, wherein said marking substance is diminished by alcohol-based disinfectant.

12. The hand cleansing verification system as recited in claim 1, wherein said third-party perceivable signal signifying actuation of said marking mechanism is at least one of an audible signal, a olfactory-perceivable signal, and a tactily-perceivable signal.

13. The hand cleansing verification system as recited in claim 1, wherein said third-party perceivable signal signifying actuation of said marking mechanism is a visible signal.

14. The hand cleansing verification system as recited in claim 1, further comprising a data recorder in signal communication with said signal generator.

15. The hand cleansing verification system as recited in claim 14, wherein said data recorder stores data representative of actuation signal receipts and the relative time of each receipt.

16. The hand cleansing verification system as recited in claim 14, further comprising a user identification detection device in signal communication with said data recorder, said user identification detection device generating data representative of respectively detected users.

17. The hand cleansing verification system as recited in claim 16, wherein said data recorder stores data representative of actuation signal receipts paired with respective data from said user identification detection device representative of identification of a correspondingly detected user.

18. The hand cleansing verification system as recited in claim 16, wherein said user identification detection device is an RFID tag reader.

19. A method for verifying thorough hand cleansing, said method comprising:

actuating a hand marking mechanism and thereby dispensing a marking substance onto a user's hand, said dispensed marking substance being third-party identifiable until diminished by sufficiently prolonged exposure to disinfectant;

generating, in response to actuation of the hand marking mechanism, an actuation signal at a signal generator and transmitting the generated actuation signal to a signaling mechanism; and producing a third-party perceivable signal at said signaling mechanism that signifies actuation of said hand marking mechanism and thereby facilitating third-party verification of thorough hand cleansing by the user.

20. The method for verifying thorough hand cleansing as recited in claim 19, wherein said actuation signal is wirelessly transmitted from said signal generator to said signaling mechanism.

* * * * *